US010099357B2

(12) United States Patent
Yang et al.

(10) Patent No.: US 10,099,357 B2
(45) Date of Patent: Oct. 16, 2018

(54) FLOOR NAILING GUN APPLICABLE TO A FLOOR HAVING A LATERAL SIDE WITH A RECESS STRUCTURE OR A PROTRUSION STRUCTURE

(71) Applicant: TAIZHOU DAJIANG IND. CO., LTD., Wenling, Zhejiang Province (CN)

(72) Inventors: Ming-Jun Yang, Wenling (CN); Zai-Jun Zhu, Wenling (CN); Song-Song Shao, Wenling (CN)

(73) Assignee: TAIZHOU DAJIANG IND. CO., LTD., Wenling, Zhejiang Province (CN)

( * ) Notice: Subject to any disclaimer, the term of this patent is extended or adjusted under 35 U.S.C. 154(b) by 394 days.

(21) Appl. No.: 15/005,233

(22) Filed: Jan. 25, 2016

(65) Prior Publication Data

US 2016/0271776 A1 Sep. 22, 2016

(30) Foreign Application Priority Data

Mar. 19, 2015 (CN) ..... 2015 2 0157877 U

(51) Int. Cl.
*B25C 7/00* (2006.01)

(52) U.S. Cl.
CPC ..... *B25C 7/00* (2013.01)

(58) Field of Classification Search
CPC ..... B25C 1/04; B25C 3/002; B25C 7/00
USPC ..... 227/148, 119, 140, 147, 151, 156, 8
See application file for complete search history.

(56) References Cited

U.S. PATENT DOCUMENTS 7,882,994 B2 * 2/2011 Francescon ..... B25C 7/00
227/119

* cited by examiner

*Primary Examiner* — Nathaniel Chukwurah
(74) *Attorney, Agent, or Firm* — Tim Tingkang Xia, Esq.; Locke Lord LLP

(57) ABSTRACT

A floor nailing gun applicable to a floor having a lateral side with a recess structure or a protrusion structure includes a floor nailing gun main body that has a base plate for matching an upper surface of the floor, a supporting seat for matching the ground, and a positioning block used for matching the recess structure or the protrusion structure of the lateral side of the floor. The base plate and the supporting seat are respectively disposed on upper and lower sides of the floor nailing gun main body by a fastener. The positioning block is fastened between an end portion of the floor nailing gun main body such that the positioning block is positioned between the base plate and the supporting seat. The positioning block comprises at least two positioning surfaces.

7 Claims, 4 Drawing Sheets

FLOOR NAILING GUN APPLICABLE TO A FLOOR HAVING A LATERAL SIDE WITH A RECESS STRUCTURE OR A PROTRUSION STRUCTURE

CROSS-REFERENCE TO RELATED APPLICATION

This application claims the priority to Chinese Patent Application No. 201520157877.1, filed on Mar. 19, 2015, in the State Intellectual Property Office of P.R. China, which is hereby incorporated herein in its entirety by reference.

FIELD OF THE INVENTION

The present invention relates generally to nail guns, and more particularly, to a floor nailing gun applicable to a floor having a lateral side provided with a recess structure or a protrusion structure.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art.

With the continuous development of the wood floor market, types of the wood floor are also diversified. Accordingly, binding manners for the wood floor continuously change, and higher requirements are raised on binding. Conventionally, a floor nailing gun can only bind on a protrusion structure of a lateral side of a floor, and cannot bind on a recess structure of a lateral side of a floor. This limitation severely restricts the installation efficiency.

Therefore, heretofore unaddressed needs exist in the art to address the aforementioned deficiencies and inadequacies.

SUMMARY OF THE INVENTION

In view of the foregoing, a positioning structure of a floor nailing gun for installing both a floor having a lateral side with a recess structure and a floor having a lateral side with a protrusion structure is needed.

One of the objectives of the present invention is to provide a positioning structure of a floor nailing gun applicable to a floor having a lateral side with a recess structure or a protrusion structure, so as to resolve the deficiencies in the prior art where binding is allowed only to a floor having a lateral side with a protrusion structure, but not to a floor having a lateral side with a recess structure.

In one aspect of the present invention, the floor nailing gun applicable to a floor having a lateral side provided with a recess structure or a protrusion structure includes a floor nailing gun main body.

The floor nailing gun main body comprises a base plate used for matching an upper surface of the floor, disposed on an upper side of the floor nailing gun main body; a supporting seat used for matching the ground, disposed on a lower side of the floor nailing gun main body; and a positioning block used for matching the recess structure or the protrusion structure of the lateral side of the floor, fastened between an end portion of the floor nailing gun main body such that the positioning block is positioned between the base plate and the supporting seat. The positioning block comprises at least two positioning surfaces. The base plate and the supporting seat are respectively fastened on the upper and lower sides of the main body by a fastener.

In one embodiment, the positioning block further comprises a flange used for matching the recess structure or the protrusion structure of the lateral side of the floor, and wherein an upper part of the flange is provided with an inclined plane to protect the lateral edge of the floor.

In one embodiment, the fastener comprises an adjusting knob.

In one embodiment, a lateral side of the floor nailing gun main body is provided with a graduation ruler, the base plate is provided with positioning graduations matching the graduation ruler, and the supporting seat is provided with graduations matching the graduation ruler.

In one embodiment, each of the base plate and the supporting seat is provided with a strip-type through hole, and the fastener runs through the strip-type through hole and is fastened on the upper and lower sides of the floor nailing gun main body.

In one embodiment, the end portion of the floor nailing gun main body has a slot defined between the two lateral sides of the floor nailing gun main body, and wherein a protruding column protrudes upwards in the slot.

In one embodiment, the positioning block is fastened in the slot between the two lateral sides of the floor nailing gun main body.

In one embodiment, the positioning block is provided with a groove that matches the protruding column so as to prevent movement of the positioning block.

According to the positioning structure of the floor nailing gun of the present invention, the positioning block is provided with at least two positioning surfaces. With this double positioning surface structure, when a floor having a lateral side with a protrusion structure is used, a corresponding positioning surface of the positioning block is set in a recessed state, thereby effectively protecting edges and corners of the floor while positioning. In addition, with the double positioning surface structure of the positioning block, the floor nailing gun can be applied to not only a floor having a lateral side with a recess structure, but also a floor having a lateral side with a protrusion structure, thereby enhancing the product compatibility.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention.

DEMARKED DESCRIPTION OF THE INVENTION

Figure 1:
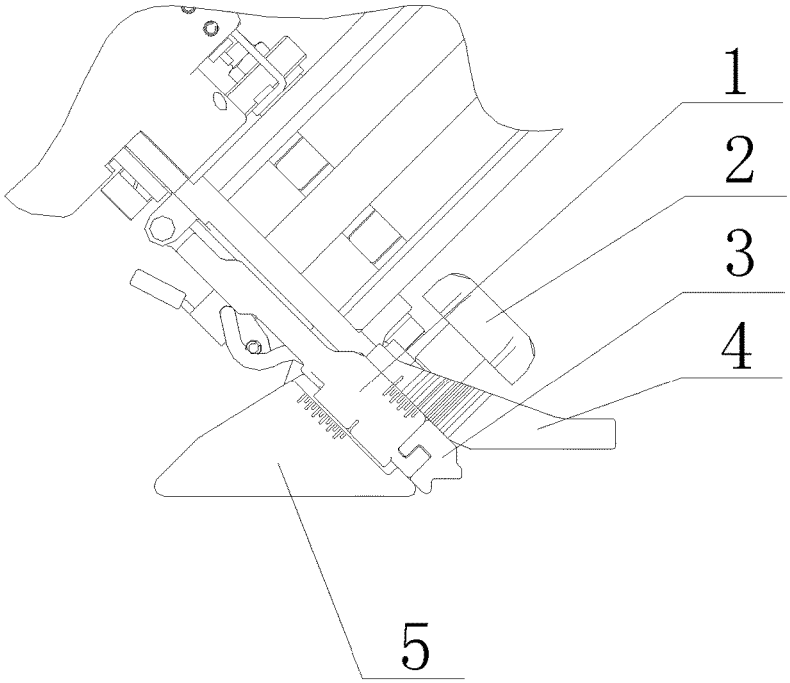
FIG. 1 is a schematic diagram of a positioning structure of a floor nailing gun applicable to a floor having a lateral side with a recess structure or a protrusion structure according to one embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The description will be made as to the embodiments of the present invention in conjunction with the accompanying drawings. In accordance with the purposes of this invention, as embodied and broadly described herein, this invention, in one aspect, relates to a floor nailing gun applicable to a floor having a lateral side provided with a recess structure or a protrusion structure.

Figure 2:
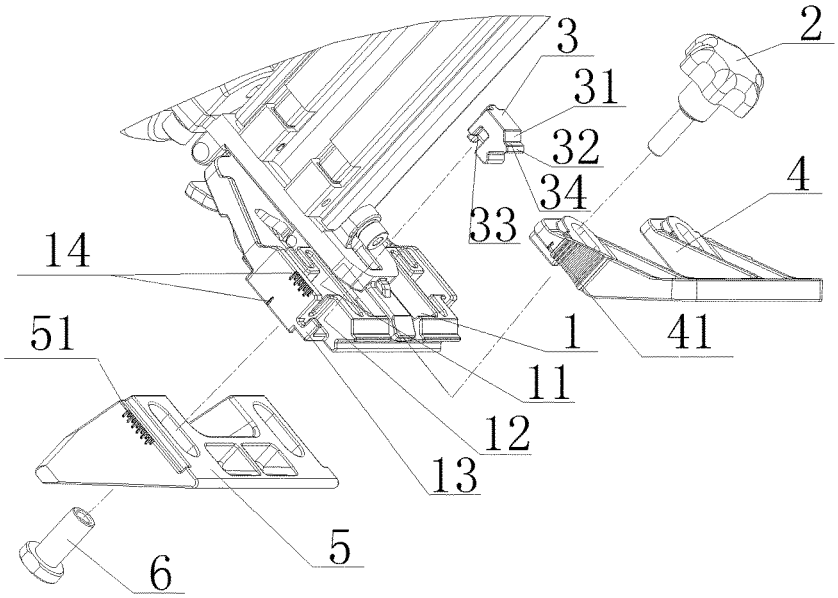
FIG. 2 is an exploded view of the positioning structure of the floor nailing gun shown in FIG. 1.

As shown in FIGS. 1 and 2, a floor nailing gun applicable to a floor having a lateral side provided with a recess structure or a protrusion structure includes a floor nailing gun main body 1. The floor nailing gun main body 1 includes a base plate 4, a positioning block 3, and a supporting seat 5. The base plate 4 and the supporting seat 5 are respectively fastened on upper and lower sides of the floor nailing gun main body 1 by a fastener. In one embodiment, the fastener includes an adjusting knob 2 and an inner threaded nut 6 matching the adjusting knob 2. As assembled, the adjusting knob 2 is threaded into the inner threaded nut 6. The base plate 4 is disposed on the upper side of the floor nailing gun main body 1, and used for matching an upper surface of a floor. The supporting seat 5 is disposed on the lower side of the floor nailing gun main body 1, and used for matching the ground. The positioning block 3 is fastened between an end portion of the floor nailing gun main body 1 such that the positioning block 3 is positioned between the base plate 4 and the supporting seat 5, and used for matching the recess structure or the protrusion structure of the lateral side of the floor. In one embodiment, the positioning block 3 is fastened in a slot 12 between the two lateral sides of the floor nailing gun main body 1.

In one embodiment, the positioning block 3 is provided with at least two positioning surfaces, that is, a first positioning surface 31 and a second positioning surface 32. In this embodiment, the positioning block 3 is provided with a flange 35 used for matching the recess structure or the protrusion structure of the lateral side of the floor, where an upper part of the flange 35 is provided with an inclined plane 34, to protect edges and corners of the floor.

For better positioning, in one embodiment, a lateral side of the floor nailing gun main body 1 is provided with a graduation ruler 14. The base plate 4 is provided with positioning graduations 41 matching the graduation ruler 14. The supporting seat 5 is also provided with graduations 51 matching the graduation ruler 14.

To facilitate a position adjustment, each of the base plate 4 and the supporting seat 5 is provided with a strip-type through hole 11. The fastener runs through the strip-type through hole 11 and is fastened on the upper and lower sides of the floor nailing gun main body 1.

To prevent a movement of the positioning block 3, a protruding column 13 protruding upwards is formed in the slot 12, and the positioning block 3 is provided with a groove 33 that matches the protruding column 13. As assembled, the protruding column 13 in the slot 12 is received in the groove 33 of the positioning block 3.

According to the positioning structure of the floor nailing gun of the present invention, the positioning block is provided with at least two positioning surfaces. With this double positioning surface structure, when a floor having a lateral side with a protrusion structure is used, a corresponding positioning surface of the positioning block is set in a recessed state, thereby effectively protecting edges and corners of the floor while positioning. In addition, with the double positioning surface structure of the positioning block, the floor nailing gun can be applied to not only a floor having a lateral side with a recess structure, but also a floor having a lateral side with a protrusion structure, thereby enhancing the product compatibility.

Figure 3:
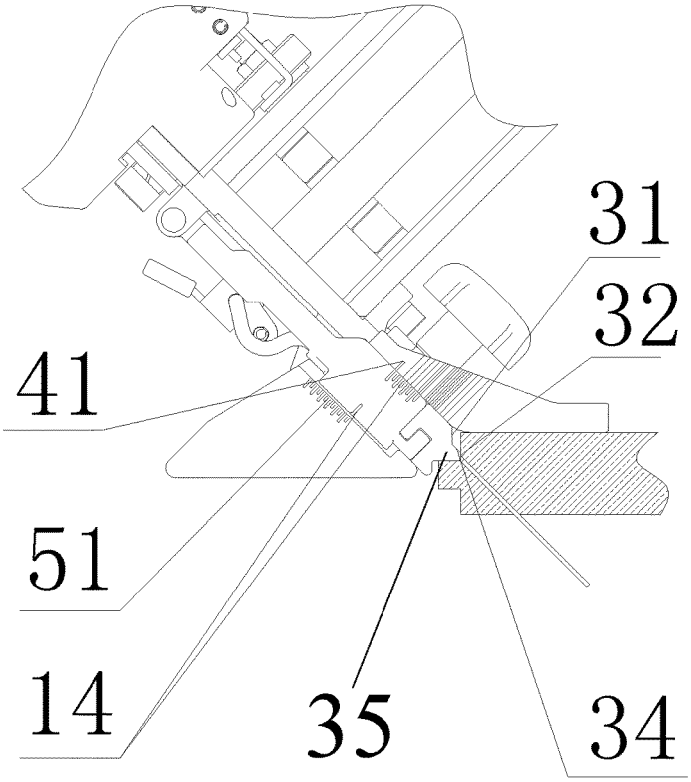
FIG. 3 is a schematic diagram showing an application of the floor nailing gun to a floor having a lateral side with a protrusion structure.

FIG. 3 shows an application of the floor nailing gun, where a lateral side of a floor has a protrusion structure. Accordingly, the positioning block 3 is positioned by using the positioning surface 32 of the positioning block 3.

Figure 4:
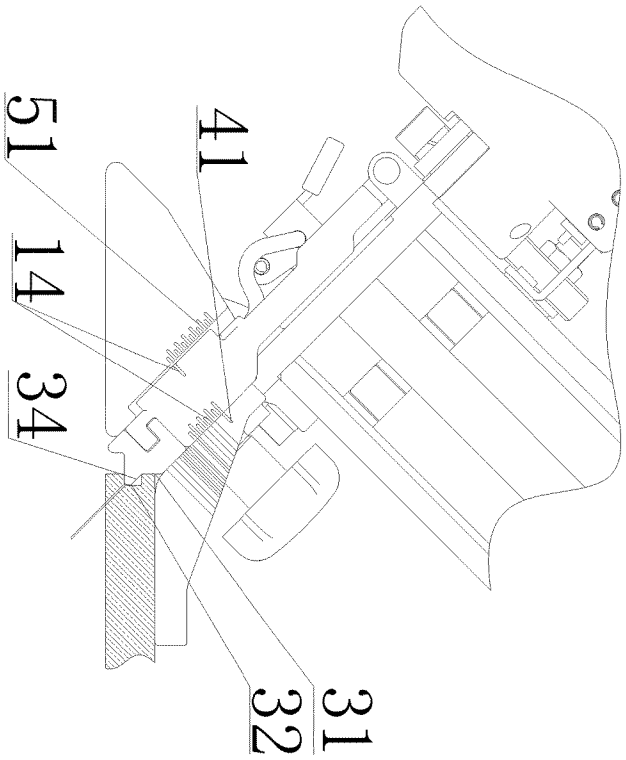
FIG. 4 is a schematic diagram showing an application of the floor nailing gun to a floor having a lateral side with a cress structure.

FIG. 4 shows another application of the floor nailing gun, where a lateral side of a floor has a recess structure. Accordingly, the positioning block 3 is positioned by using the positioning surface 31 of the positioning block 3.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims, the foregoing description and the exemplary embodiments described therein, and accompanying drawings.

What is claimed is:

1. A floor nailing gun applicable to a floor having a lateral side provided with a recess structure or a protrusion structure, comprising:

a floor nailing gun main body, wherein the floor nailing gun main body comprises:

a base plate used for matching an upper surface of the floor, disposed on an upper side of the floor nailing gun main body;

a supporting seat used for matching the ground, disposed on a lower side of the floor nailing gun main body; and a positioning block used for matching the recess structure or the protrusion structure of the lateral side of the floor, fastened between an end portion of the floor nailing gun main body such that the positioning block is positioned between the base plate and the supporting seat;

wherein the positioning block comprises at least two positioning surfaces;

wherein the base plate and the supporting seat are respectively fastened on the upper and lower sides of the main body by a fastener; and wherein a lateral side of the floor nailing gun main body is provided with a graduation ruler, the base plate is provided with positioning graduations matching the graduation ruler, and the supporting seat is provided with graduations matching the graduation ruler.

2. The floor nailing gun according to claim 1, wherein the positioning block further comprises a flange used for matching the recess structure or the protrusion structure of the lateral side of the floor, and wherein an upper part of the flange is provided with an inclined plane to protect the lateral edge of the floor.

3. The floor nailing gun according to claim 1, wherein the fastener comprises an adjusting knob.

4. The floor nailing gun according to claim 1, wherein each of the base plate and the supporting seat is provided with a strip-type through hole, and the fastener runs through the strip-type through hole and is fastened on the upper and lower sides of the floor nailing gun main body.

5. A floor nailing gun applicable to a floor having a lateral side provided with a recess structure or a protrusion structure, comprising:

a floor nailing gun main body, wherein the floor nailing gun main body comprises:

a base plate used for matching an upper surface of the floor, disposed on an upper side of the floor nailing gun main body;

a supporting seat used for matching the ground, disposed on a lower side of the floor nailing gun main body; and a positioning block used for matching the recess structure or the protrusion structure of the lateral side of the floor, fastened between an end portion of the floor nailing gun main body such that the positioning block is positioned between the base plate and the supporting seat;

wherein the positioning block comprises at least two positioning surfaces;

wherein the base plate and the supporting seat are respectively fastened on the upper and lower sides of the main body by a fastener; and wherein the end portion of the floor nailing gun main body has a slot defined between the two lateral sides of the floor nailing gun main body, and wherein a protruding column protrudes upwards in the slot.

6. The floor nailing gun according to claim 5, wherein the positioning block is fastened in the slot between the two lateral sides of the floor nailing gun main body.

7. The floor nailing gun according to claim 6, wherein the positioning block is provided with a groove that matches the protruding column so as to prevent movement of the positioning block.

* * * * *